United States Patent [19]

Burgess

[11] 4,117,346

[45] Sep. 26, 1978

[54] THERMAL POWER SUSTAINING SWITCH

[76] Inventor: Eldon W. Burgess, 3343 Marinda Way, Salt Lake City, Utah 84121

[21] Appl. No.: 746,849

[22] Filed: Dec. 2, 1976

[51] Int. Cl.[2] ..... H01H 7/06; H01H 37/52; H01H 61/02

[52] U.S. Cl. ..... 307/117; 337/37; 361/211

[58] Field of Search ..... 307/141.4, 116, 117, 307/125, 126, 131, 132 T, 141, 10 LS; 337/14, 15, 16, 35, 36, 37, 39, 113; 361/164, 195, 211

[56] References Cited

U.S. PATENT DOCUMENTS

| | | | |
|---|---|---|---|
| 1,328,477 | 1/1920 | Baker | 361/211 |
| 1,328,482 | 1/1920 | Baker | 337/37 |
| 1,335,709 | 3/1920 | Björnsen | 361/211 |
| 3,943,375 | 3/1976 | Williamson | 307/141 |

*Primary Examiner*—L. T. Hix
*Assistant Examiner*—S. D. Schreyer
*Attorney, Agent, or Firm*—M. Wayne Western

[57] ABSTRACT

A power sustaining thermal switch placed in shunt with an existing electrical switch results in the flow of electricity through the thermal switch for a predetermined period of time after the existing switch has been turned off. Thus sustaining power in the thermal switch circuit for supply to an electrical device.

8 Claims, 2 Drawing Figures

THERMAL POWER SUSTAINING SWITCH

BACKGROUND OF THE INVENTION

This invention relates to a power sustaining switch. More particularly this invention relates to a power sustaining switch that is thermally actuated and is connected by a divided circuit with an existing switch such that power continues to flow through the thermal switch for a predetermined time after the existing switch has been turned off.

There are many applications where the sustained delivery of electrical current to an electrically operated device for a predetermined time would be desirable. This is especially true for a light which would remain on for a predetermined period of time after the light switch had been turned off. This sustained mode of operation would allow a person to close a garage door; to walk from one room to another, from building to building, from house to a car or even to get into bed before the light went off. It is all too common to turn a light off and then have to "feel one's way" through the dark often bumping into some unexpected object. For this reason some lights are controlled by a timer switch which is set to turn a light off or an at preset intervals.

OBJECTS AND BRIEF DESCRIPTION OF THE INVENTION

It is an object of the present invention to provide a power sustaining switch which will act as an appendage to an existing switch.

It is also an object of this invention to provide a power sustaining switch attached to an existing switch wherein the sustaining or holding period may be a function of the wattage of the light or other electric load.

A still further object of the present invention is to provide a thermally actuated power sustaining switch as an appendage to an existing switch wherein the sustaining or holding period is dependent upon the temperature of the thermally actuated switch.

An additional object of this invention is to provide a thermally actuated power sustaining switch wherein the current is automatically diminished in the sustained mode thus indicating a sustained operation.

Another object of this invention is to provide a thermally operated power sustaining switch which has no effect on the existing switch during turn-on operation, which consumes no power when the existing switch is turned off and provides fail safe operation of the existing switch.

These and other objects may be accomplished by means of a thermally controlled power sustaining switch connected as an appendage to an existing switch. Basically the power sustaining system consists of a thermally actuated switch, an isolating device and a thermal switch heating element. The power sustaining switch is connected to the existing switch such that the electric current to a light, for example, flows through the heating element thereby causing the thermal switch to close. The thermal switch circuit is in parallel with the existing switch. Stored heat from the heating element causes the thermal switch to remain closed after the existing switch has been turned off. The isolating means or device controls the flow of electricity through the thermal switch. The thermal switch continues to allow the flow of power to the light until the stored heat in the thermal switch is dissipated causing the thermal switch to open and the light to go off.

The novel features of this invention both as to the manner of construction or organization as well as the operation will be better understood with reference to the following description and drawings. It is to be understood, however, that the description and drawings are for the purpose of illustration only and are not intended to be a definition as to the scope of this invention.

DRAWINGS OF THE INVENTION

DETAILED DESCRIPTION

Figure 1:
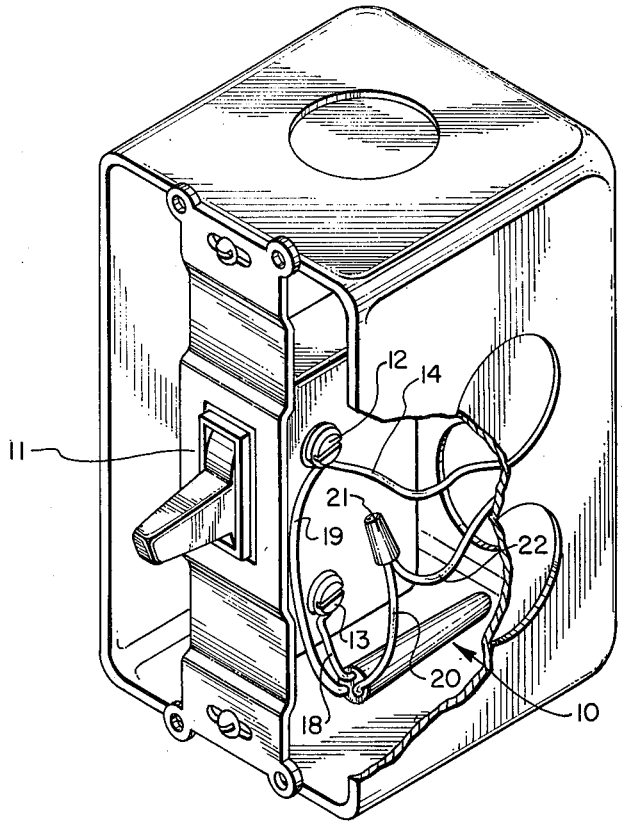
FIG. 1 is a perspective view of the power sustaining switch connected to an existing wall switch.

Referring now to the drawings.

Figure 2:
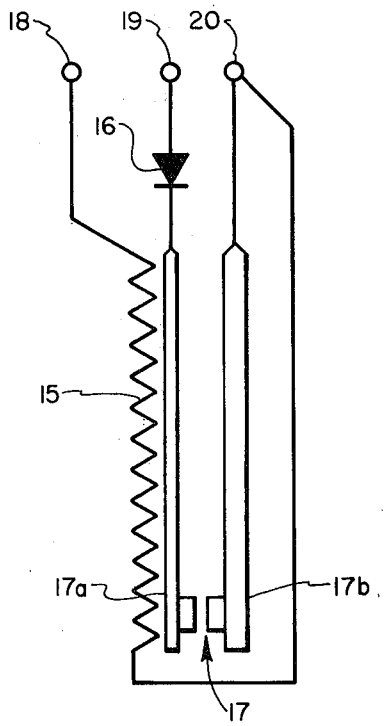
FIG. 2 is a schematic diagram of the power sustaining switch depicting a divided circuit having two branches and the various parts contained therein.

There is shown in FIGS. 1 and 2 an operative embodiment of the present invention. The power sustaining switch 10 is shown in FIG. 1 connected with an existing wall switch 11. The terms "existing switch" or "wall switch" could obviously refer to new switches installed along with or at the same time as power sustaining switch 10. The ordinary function of the existing switch is to isolate terminals 12 and 13 when the switch is in the open or off position. When the switch is turned on or closed electricity is caused to flow from wire 14 secured to terminal 12, through switch 11 and out terminal 13 via wire 22 which is normally connected to terminal 13 for delivery to a light or other electrical device. The invention will hereinafter be applied to the operation of a light.

In its simplest form the power sustaining switch comprises a divided circuit containing a heating element 15 in one branch, and an isolating device such as a rectifying diode 16 and a bimetallic switch 17 consisting of a bimetallic element with contact **17*a* and a stationary contact 17*b* in the second branch. If desired additional mass may be provided to the power sustaining switch to serve as a heat sink for maintaining the temperature created by the heating element 15** as will be hereinafter described.

When connecting the power sustaining switch 10 to an existing switch 11 as an appendage thereof existing wire 22 is removed from terminal 13 and wire 18 connected to heating element 15 is secured to terminal 13. Wire 22 is connected to wire 20 thus the heating element 15 is connected in series between the existing switch and the light and constitutes a first branch of the divided circuit. When switch 11 is open or off no current flows to heating element 15. Wire 19 leading to the rectifying diode 16 and bimetallic contact **17*a* is connected to terminal 12. Connecting the heating element 15 in series with the light circuit results in the electric current drawn by the light going through the heating element 15 whenever the existing switch 11 is closed or on. This electric current produces a small quantity of heat thereby heating the thermal bimetallic switch 17 in the second branch. The heat causes each metal in the bimetallic switch element containing contact 17*a* to expand at different rates bring contact 17*a* in contact with stationary contact 17*b* thereby placing thermal switch 17 in operation. Residual heat is stored in the mass of the power sustaining siwtch 10. This stored heat energy causes the thermal switch 17 to remain in an on or closed position after the existing switch 11 has been turned off until sufficient heat dissipates from the power sustaining switch 10 to cause bimetallic contact 17***a* to retract thereby opening the thermal switch 17. The amount of heat stored in the power sustaining switch 10 after switch 11 is turned off and the rate heat dissipation determine the amount of time the thermal switch 17 will remain closed and supply electricity to the light.

As shown in FIGS. 1 and 2 the rectifying diode 16 is used as an isolation means or device and is connected in series between the power supply line 14 and thermal switch 17. This series arrangement forms the second branch of the divided circuit and is in-turn connected across or in parallel with the existing switch 11 and heating element 15 such that the thermal switch 17 and rectifying diode 16 are bridged across the existing switch 11 and heating element 15.

The diode 16 prevents the thermal switch 17 from shorting out the heating element 15 when the thermal switch 17 is closed or on. Without the diode, or other isolating element, the thermal switch 17 would directly bridge or short out the heating element 15 and cause erratic operation. The loss of heat input to the thermal switch 17 would result in premature dissipation of the stored heat energy and the power sustaining feature would not be assured.

The diode provides for half-wave rectification thereby allowing only about one-half of the current to flow to the bimetallic contact 17*a*. The diode 16 therefore partially isolates the thermal switch 17 and allows a portion of the light current to flow through both the heating element 15 and the thermal switch 17 when the existing switch 11 is on, thus maintaining the supply of heat to thermal switch 10.

When the existing switch 11 is first turned on full current drawn by the light will flow through the heating element 15 to tap wire 20 which connects at juncture 21 with wire 22 leading to the light. The heating element 15 heats the power sustaining switch mass causing the thermal switch 17 to close. Until switch 17 closed switch 11 may be turned off and there will be no sustained power. When switch 17 closes a partial flow of current will flow through existing switch 11, providing that switch is turned on, and through heating element 15 to the light thereby allowing a portion of the current to continue to supply stored heat energy to switch 10. The remainder of the current by-passes existing switch 11 flowing from terminal 12 via tap line 19, through the diode 16 and thermal switch 17 via wire 20 to the light via wire 22. Full current is thus provided to line 22 through parallel routes.

When the existing switch is turned off electricity continues to flow from wire 14, through connecting terminal 12 and tap wire 19 to diode 16 where half wave rectification occurs. The reduced flow of current to thermal switch 17 dims the light and places the switch 10 in the sustained mode of operation. Heat will dissipate from switch 10 since current is no longer flowing to heater element 15. When the temperature of the bimetallic element containing contact 17*a* causes the expanded metal to contract the circuit is broken and the light is automatically turned off.

While the invention is preferably utilized with a light and has been described as such, other electrically powered devices could be used.

The heating element may have a plurality of taps so that a selection of heater resistance can be made for adjusting the quantity of stored heat energy and thus the period of time the switch 10 will remain in the sustained mode. A plurality of taps to the heating element 15 will also accommodate a variety of light wattages for use in different locations and applications as desired and to accommodate various wattages and adjust the sustaining period to the same relative times.

In general the power sustaining switch 10 is sufficiently small that it can be placed in the switch box along with switch 11. Switch 11 will generally be a wall switch.

While a diode has been used as the isolating element other isolating elements may be used. For example the use of two diodes 180° out of phase will provide full wave rectification. Thus isolating devices such as multiple diodes, rectifying devices, resistos, reactances and the like may be used without departing from the scope of this invention.

Although the invention as has been described is deemed to be that which would form the preferred embodiment of the invention, it is recognized that departures may be made therefrom without departing from the scope of the invention which is not to be limited details disclosed, but is to be accorded the full scope of the claims so as to include any and all equivalent devices and apparatus.

I claim:

1. A thermal power sustaining switch having a divided circuit consisting of two branches connectable to an existing switch as an appendage thereto comprising:

(a) A first branch of the divided circuit containing a heating element connectable in series between the existing switch and an electrical device and adapted to heat the thermal power sustaining switch and provide a flow of electricity through said first branch when the existing switch is in a closed position, and (b) a second branch of the divided circuit connectable in parallel with the first branch and the existing switch between the power input line to the existing switch and an electrical device, said second branch containing, in series an isolating device consisting of one or more diodes and a thermal switch such that when the thermal switch is closed electricity will flow through said second branch.

2. A thermal power sustaining switch as claimed in claim 1 wherein the thermal switch is a bimetallic switch.

3. A power sustaining switch according to claim 2 wherein the full current drawn by the electrical device flows through the first branch of the divided circuit until the power sustaining device is sufficiently heated to close the bimetallic thermal switch in the second branch of the divided circuit.

4. A power sustaining switch according to claim 2 wherein current flows through both branches of the divided circuit to the electrical device when the existing switch is in a closed position and the bimetallic thermal switch is closed.

5. A power sustaining switch according to claim 2 wherein current flows through the second branch of the divided circuit to the electrical device as long as the bimetallic thermal switch is closed and the existing switch is open.

6. A power sustaining switch according to claim 5 wherein the diode allows only a partial flow of current to the electrical device reducing the power to the electrical device in a sustained mode of operation.

7. A combination consisting of an on-off switch and a thermal power sustaining switch having a divided circuit consisting of two branches connected to said on-off switch wherein:

(a) the first branch of the divided circuit contains a heating element connected in series between the existing switch and an electrical device and adapted to heat the thermal power sustaining switch and provide a flow of electricity through said first branch when the existing switch is in an on position, and (b) the second branch of the divided circuit is connected in parallel with the first branch and the existing switch between the power input line to the existing switch and an electrical device said second branch containing, in series, an isolating device consisting of one or more diodes and a thermal switch such that when the thermal switch is closed electricity will flow through said second branch.

8. A combination as claimed in claim 7 wherein the thermal switch is a bimetallic switch.

* * * * *